US011694641B2

(12) United States Patent
Mohtashemi et al.

(10) Patent No.: US 11,694,641 B2
(45) Date of Patent: Jul. 4, 2023

(54) SYSTEMS AND METHODS FOR INCREASING A PULSE WIDTH MODULATION FREQUENCY WHILE PRESERVING RESOLUTION

(71) Applicant: Apple Inc., Cupertino, CA (US)

(72) Inventors: Behzad Mohtashemi, Los Gatos, CA (US); Mohammad J Navabi-Shirazi, Phoenix, AZ (US); Feng Guo, Santa Clara, CA (US); Omar Alnaggar, Palo Alto, CA (US); Venkataraman V Iyer, Sunnyvale, CA (US); Jingdong Chen, San Jose, CA (US); Yang Zhang, Saratoga, CA (US); Ming Gu, San Jose, CA (US); Asif Hussain, Clearwater, FL (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 17/870,576

(22) Filed: Jul. 21, 2022

(65) Prior Publication Data

US 2023/0100812 A1 Mar. 30, 2023

Related U.S. Application Data

(60) Provisional application No. 63/248,316, filed on Sep. 24, 2021.

(51) Int. Cl.
*G09G 3/34* (2006.01)

(52) U.S. Cl.
CPC ..... *G09G 3/3406* (2013.01); *G09G 2310/08* (2013.01); *G09G 2320/064* (2013.01)

(58) Field of Classification Search
None
See application file for complete search history.

(56) References Cited

U.S. PATENT DOCUMENTS

| | | | | |
|---|---|---|---|---|
| 7,227,476 | B1 | 6/2007 | Wong | |
| 8,719,749 | B2 | 5/2014 | Birns et al. | |
| 9,093,032 | B2 | 7/2015 | Hussain et al. | |
| 2015/0310828 | A1* | 10/2015 | Gotoh | G09G 3/3406 345/205 |
| 2020/0312231 | A1* | 10/2020 | Hussell | G09G 3/2085 |

* cited by examiner

*Primary Examiner* — Chad M Dicke
(74) *Attorney, Agent, or Firm* — Fletcher Yoder, P.C.

(57) ABSTRACT

Systems and methods for preserving a pulse width modulation (PWM) resolution while increasing the frequency of a pulse width modulation (PWM) clock are provided. An electronic display backlight system may include a backlight element and backlight dimming circuitry. The backlight element may be driven according to a pulse width modulation (PWM) signal over a PWM clock cycle equal to a multiple M of a baseline PWM clock frequency associated with a baseline PWM resolution. The backlight dimming circuitry may receive a brightness code of the baseline PWM resolution and generate the PWM signal at least in part by dividing the brightness code by M.

21 Claims, 9 Drawing Sheets

SYSTEMS AND METHODS FOR INCREASING A PULSE WIDTH MODULATION FREQUENCY WHILE PRESERVING RESOLUTION

CROSS-REFERENCE TO RELATED APPLICATIONS

This application claims priority to U.S. Provisional Application No. 63/248,316, entitled "Systems and Methods for Increasing a Pulse Width Modulation Frequency While Preserving Resolution," filed Sep. 24, 2021, the disclosure of which is incorporated by reference in its entirety for all purposes.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Numerous electronic devices—including cellular devices, televisions, handheld devices, and notebook computers—may display images and videos on an electronic display. Some electronic displays have display pixels that selectively filter light from a backlight behind the display pixels to produce images. For example, a liquid crystal display (LCD) may use display pixels that contain a liquid crystal material. Adjusting an electric field that is applied to the liquid crystal material modulates the amount of light that is permitted through the display pixel. A backlight supplies the light that is modulated. In many cases, the backlight may be dimmed by applying a pulse width modulation signal at a particular duty cycle. For example, a 100% duty cycle would emit the most light, while a 50% duty cycle would emit half as much light assuming other factors remain constant. In other words, over time, rapidly activating and deactivating the backlight at varying proportions of time that the backlight is on in relation to time that the backlight is off causes the average amount of light to vary accordingly.

The baseline resolution of possible duty cycles for PWM dimming depends on two clocks: a PWM clock that defines a total PWM period and a counter clock that subdivides the PWM clock cycles. The resolution may be defined as $\mathrm{Log}_2(F_{COUNT}/F_{PWM})$. For example, when the PWM clock is about 2 kHz and the counter clock is about 16 MHz, the resolution is about 13 bits. As such, a 13-bit brightness code may be used to define a count that, when counted by the counter clock, results in a PWM pulse that is a desired proportion of the PWM clock cycle. Frequencies within the range of human hearing, however, could result in audible noise in some electronic components. As such, it may be desirable to increase the frequency of the PWM clock. Yet simply increasing the frequency of the PWM clock without a corresponding increase in the counter clock would reduce the number of potential subdivisions per PWM clock cycle. This has the effect of reducing the resolution. Yet increasing the counter clock, which operates at a much higher frequency than the PWM clock, may introduce new challenges. At such higher frequencies, there may be substantially greater power consumption and parasitic degradation.

This disclosure describes systems and methods for maintaining PWM resolution while increasing the PWM clock frequency without correspondingly increasing the counter clock. In particular, a PWM clock frequency may be generated that is a multiplication factor M times greater than a baseline PWM clock frequency. The baseline PWM clock may have a frequency that, when used with a particular counter clock, has a baseline resolution. A brightness code for the baseline resolution may be used, even though the PWM clock frequency is a multiple M of the baseline PWM frequency. To preserve the resolution of the brightness code, division circuitry may divide the brightness code by the value M. Subsequently, the divided brightness code may be used over M PWM cycles. Remainders from the division operation may be added back into the divided brightness codes over the M PWM cycles, thereby preserving the resolution despite the higher frequency of the PWM clock. This enables the frequency of the PWM clock to increase, while preserving the resolution of the electronic display backlight.

Various refinements of the features noted above may exist in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended only to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings in which.

DETAILED DESCRIPTION

Figure 1:
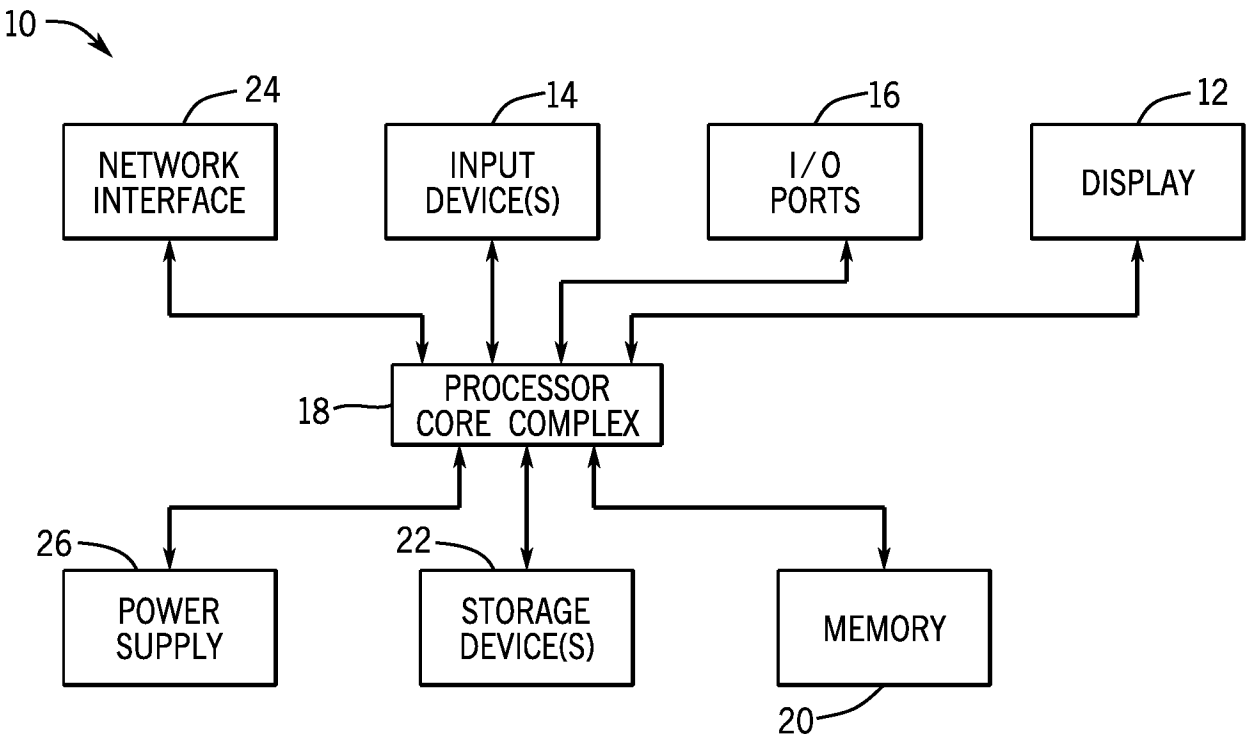
FIG. 1 is a schematic block diagram of an electronic device, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "including" and "having" are intended to be inclusive and mean that there may be additional elements other than the listed elements. Additionally, it should be understood that references to "some embodiments," "embodiments," "one embodiment," or "an embodiment" of the present disclosure are not intended to be interpreted as excluding the existence of additional embodiments that also incorporate the recited features. Furthermore, the phrase A "based on" B is intended to mean that A is at least partially based on B. Moreover, the term "or" is intended to be inclusive (e.g., logical OR) and not exclusive (e.g., logical XOR). In other words, the phrase A "or" B is intended to mean A, B, or both A and B.

Embodiments of the present disclosure relate to relatively high-resolution backlight dimming that can operate with relatively low-frequency clock signals, but which does not produce distracting audible sounds. As mentioned above, electronic displays such as liquid crystal displays (LCDs) are often illuminated by a backlight assembly. The brightness of an LCD depends on the amount of light provided by the backlight assembly. According to the present disclosure, a backlight assembly may vary the amount of light provided to the backlight by adjusting pulse width modulation (PWM) duty cycles. Over time, rapidly activating and deactivating the backlight at varying proportions of time the backlight is on relative to time the backlight is off causes the average amount of light to vary accordingly.

This disclosure describes systems and methods for maintaining PWM resolution while increasing the PWM clock frequency without correspondingly increasing the counter clock. In particular, a PWM clock frequency may be generated that is a multiplication factor M times greater than a baseline PWM clock frequency. The baseline PWM clock may have a frequency that, when used with a particular counter clock, has a baseline resolution. A brightness code for the baseline resolution may be used, even though the PWM clock frequency is a multiple M of the baseline PWM frequency. To preserve the resolution of the brightness code, division circuitry may divide the brightness code by the value M. Subsequently, the divided brightness code may be used over M PWM cycles. Remainders from the division operation may be added back into the divided brightness codes over the M PWM cycles, thereby preserving the resolution despite the higher frequency of the PWM clock. This enables the frequency of the PWM clock to increase, while preserving the resolution of the electronic display backlight.

With this in mind, an example of an electronic device 10, which includes an electronic display 12 that may benefit from these features, is shown in FIG. 1. FIG. 1 is a schematic block diagram of the electronic device 10. The electronic device 10 may be any suitable electronic device, such as a computer, a mobile (e.g., portable) phone, a portable media device, a tablet device, a television, a handheld game platform, a personal data organizer, a virtual-reality headset, a mixed-reality headset, a wearable device, a watch, a vehicle dashboard, and/or the like. Thus, it should be noted that FIG. 1 is merely one example of a particular implementation and is intended to illustrate the types of components that may be present in an electronic device 10.

In addition to the electronic display 12, as depicted, the electronic device 10 includes one or more input devices 14, one or more input/output (I/O) ports 16, a processor core complex 18 having one or more processors or processor cores and/or image processing circuitry, memory 20, one or more storage devices 22, a network interface 24, and a power supply 26. The various components described in FIG. 1 may include hardware elements (e.g., circuitry), software elements (e.g., a tangible, non-transitory computer-readable medium storing instructions), or a combination of both hardware and software elements. It should be noted that the various depicted components may be combined into fewer components or separated into additional components. For example, the memory 20 and the storage devices 22 may be included in a single component. Additionally or alternatively, image processing circuitry of the processor core complex 18 may be disposed as a separate module or may be disposed within the electronic display 12.

The processor core complex 18 is operably coupled with the memory 20 and the storage device 22. As such, the processor core complex 18 may execute instructions stored in memory 20 and/or a storage device 22 to perform operations, such as generating or processing image data. The processor core complex 18 may include one or more microprocessors, one or more application specific processors (ASICs), one or more field programmable logic arrays (FPGAs), or any combination thereof.

In addition to instructions, the memory 20 and/or the storage device 22 may store data, such as image data. Thus, the memory 20 and/or the storage device 22 may include one or more tangible, non-transitory, computer-readable media that store instructions executable by processing circuitry, such as the processor core complex 18, and/or data to be processed by the processing circuitry. For example, the memory 20 may include random access memory (RAM) and the storage device 22 may include read only memory (ROM), rewritable non-volatile memory, such as flash memory, hard drives, optical discs, and/or the like.

The network interface 24 may enable the electronic device 10 to communicate with a communication network and/or another electronic device 10. For example, the network interface 24 may connect the electronic device 10 to a personal area network (PAN), such as a Bluetooth network, a local area network (LAN), such as an 802.11x Wi-Fi network, and/or a wide area network (WAN), such as a fourth-generation wireless network (4G), LTE, or fifth-generation wireless network (5G), or the like. In other words, the network interface 24 may enable the electronic device 10 to transmit data (e.g., image data) to a communication network and/or receive data from the communication network.

The power supply 26 may provide electrical power to operate the processor core complex 18 and/or other components in the electronic device 10, for example, via one or more power supply rails. Thus, the power supply 26 may include any suitable source of electrical power, such as a rechargeable lithium polymer (Li-poly) battery and/or an alternating current (AC) power converter. A power management integrated circuit (PMIC) may control the provision and generation of electrical power to the various components of the electronic device 10.

The I/O ports 16 may enable the electronic device 10 to interface with another electronic device 10. For example, a portable storage device may be connected to an I/O port 16, thereby enabling the electronic device 10 to communicate data, such as image data, with the portable storage device.

The input devices 14 may enable a user to interact with the electronic device 10. For example, the input devices 14 may include one or more buttons, one or more keyboards, one or more mice, one or more trackpads, and/or the like. Additionally, the input devices 14 may include touch sensing components implemented in the electronic display 12, as described further herein. The touch sensing components may receive user inputs by detecting occurrence and/or position of an object contacting the display surface of the electronic display 12.

In addition to enabling user inputs, the electronic display 12 may provide visual representations of information by displaying one or more images (e.g., image frames or pictures). For example, the electronic display 12 may display a graphical user interface (GUI) of an operating system, an application interface, text, a still image, or video content. To facilitate displaying images, the electronic display 12 may include a display panel with one or more display pixels. The display pixels may represent sub-pixels that each control a luminance of one color component (e.g., red, green, or blue for a red-green-blue (RGB) pixel arrangement).

The electronic display 12 may display an image by controlling the luminance of its display pixels based at least in part image data associated with corresponding image pixels in image data. In some embodiments, the image data may be generated by an image source, such as the processor core complex 18, a graphics processing unit (GPU), an image sensor, and/or memory 20 or storage devices 22. Additionally, in some embodiments, image data may be received from another electronic device 10, for example, via the network interface 24 and/or an I/O port 16.

Figure 2:
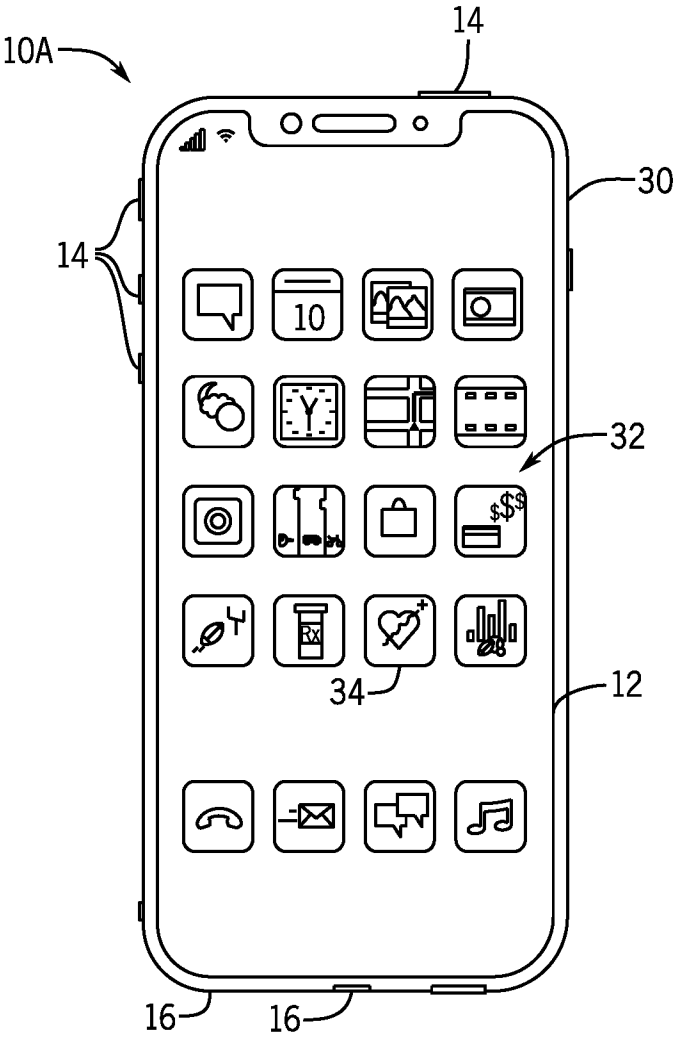
FIG. 2 is a front view of a mobile phone representing an example of the electronic device of FIG. 1, in accordance with an embodiment.

One example of the electronic device 10, specifically a handheld device 10A, is shown in FIG. 2. FIG. 2 is a front view of the handheld device 10A representing an example of the electronic device 10. The handheld device 10A may be a portable phone, a media player, a personal data organizer, a handheld game platform, and/or the like. For example, the handheld device 10A may be a smart phone, such as any iPhone® model available from Apple Inc.

The handheld device 10A includes an enclosure 28 (e.g., housing). The enclosure 28 may protect interior components from physical damage and/or shield them from electromagnetic interference. In the depicted embodiment, the electronic display 12 is displaying a graphical user interface (GUI) 30 having an array of icons 32. By way of example, when an icon 32 is selected either by an input device 14 or a touch sensing component of the electronic display 12, an application program may launch.

Input devices 14 may be provided through the enclosure 28. As described above, the input devices 14 may enable a user to interact with the handheld device 10A. For example, the input devices 14 may enable the user to activate or deactivate the handheld device 10A, navigate a user interface to a home screen, navigate a user interface to a user-configurable application screen, activate a voice-recognition feature, provide volume control, and/or toggle between vibrate and ring modes. The I/O ports 16 also open through the enclosure 28. The I/O ports 16 may include, for example, a Lightning® or Universal Serial Bus (USB) port.

Figure 3:
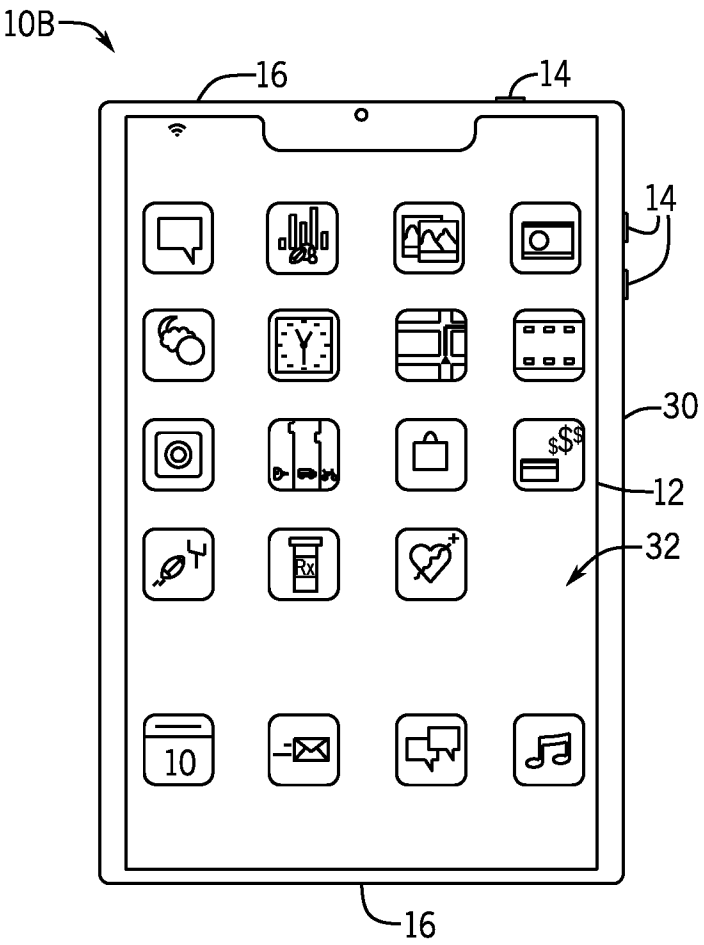
FIG. 3 is a front view of a tablet device representing an example of the electronic device of FIG. 1, in accordance with an embodiment.
Figure 4:
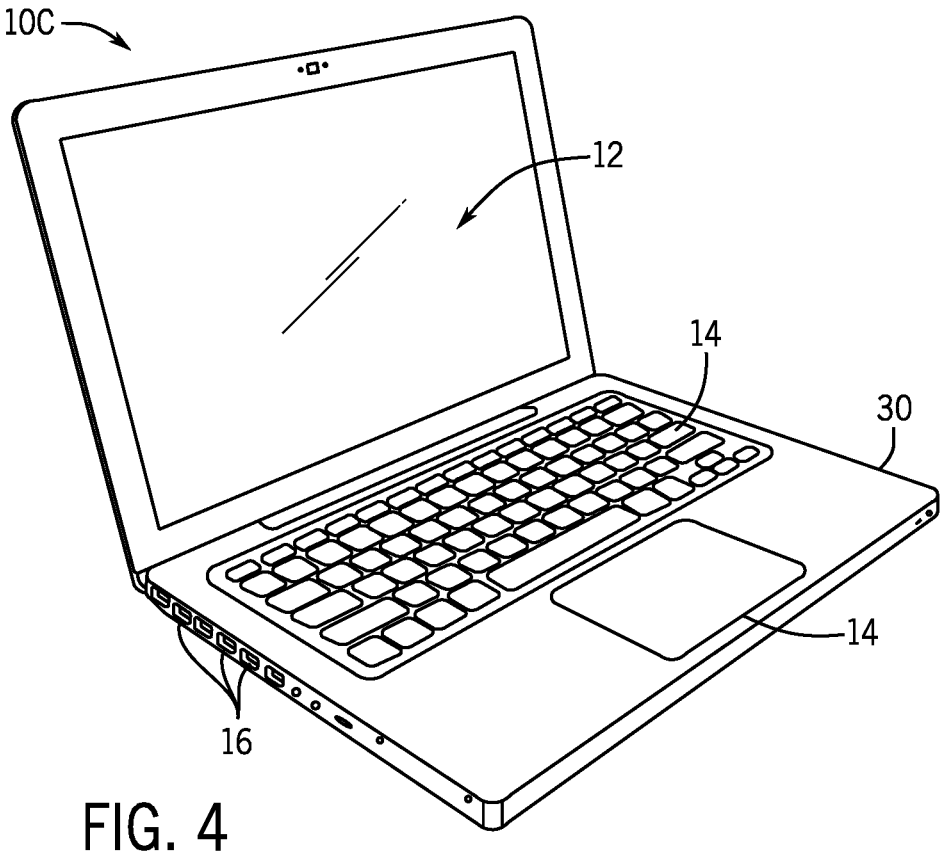
FIG. 4 is a front view of a notebook computer representing an example of the electronic device of FIG. 1, in accordance with an embodiment.
Figure 5:
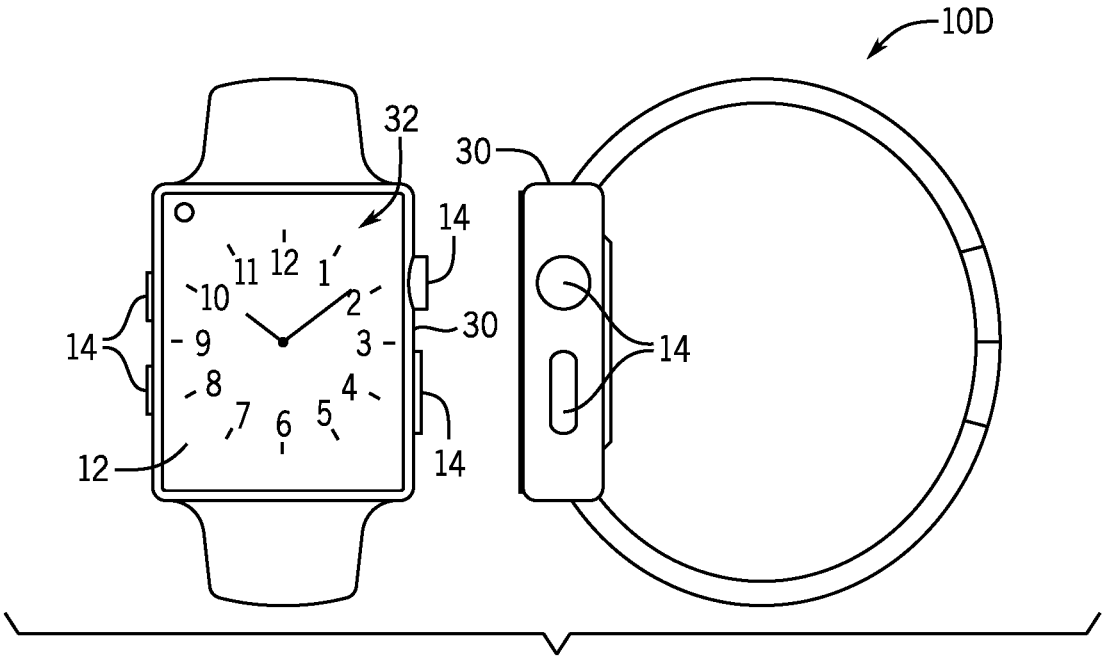
FIG. 5 illustrates side and front views of a wearable electronic device representing an example of the electronic device of FIG. 1, in accordance with an embodiment.

The electronic device 10 may take the form of a tablet device 10B, as shown in FIG. 3. FIG. 3 is a front view of the tablet device 10B representing an example of the electronic device 10. By way of example, the tablet device 10B may be any iPad® model available from Apple Inc. A further example of a suitable electronic device 10, specifically a computer 10C, is shown in FIG. 4. FIG. 4 is a front view of the computer 10C representing an example of the electronic device 10. By way of example, the computer 10C may be any MacBook® or iMac® model available from Apple Inc. Another example of a suitable electronic device 10, specifically a watch 10D, is shown in FIG. 5. FIG. 5 are front and side views of the watch 10D representing an example of the electronic device. By way of example, the watch 10D may be any Apple Watch® model available from Apple Inc. As depicted, the tablet device 10B, the computer 10C, and the watch 10D all include respective electronic displays 12, input devices 14, I/O ports 16, and enclosures 28.

Figure 6:
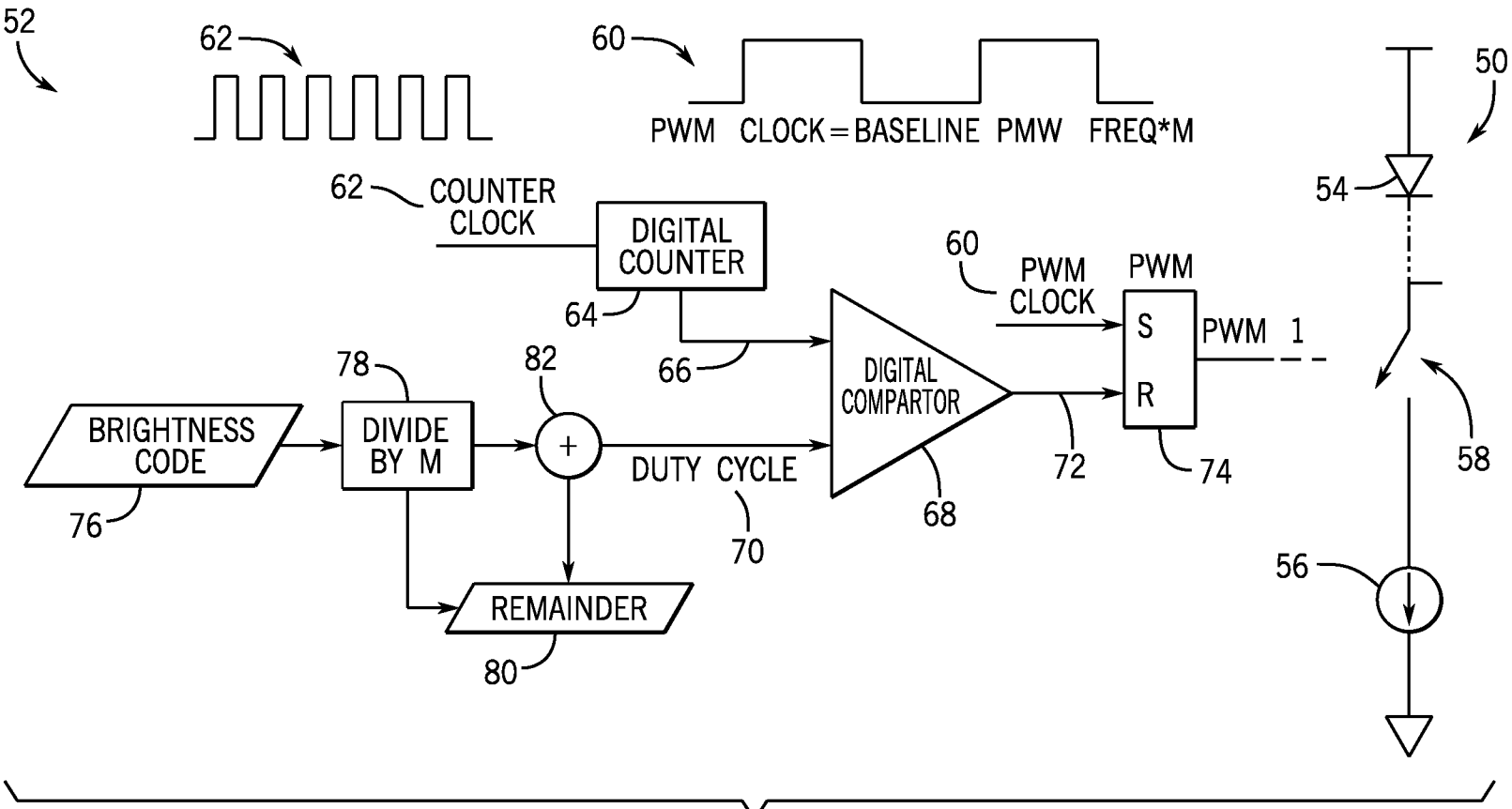
FIG. 6 is a schematic diagram of a pulse width modulation (PWM) dimming LED driver circuit, in accordance with an embodiment.

The electronic display 12 of the electronic device 10 may be illuminated by a backlight 50 that is controlled according to pulse width modulation (PWM) dimming circuitry 52 (also referred to as backlight dimming circuitry or backlight driver circuitry), as seen in FIG. 6. The backlight 50 may include any suitable number of light-emitting elements (e.g., light-emitting diodes (LEDs), organic light emitting diodes (OLEDs), micro LEDs (μ-LEDs), cold cathode tubes), represented here by way of example as an LED 54. A current source 56 may draw current through the LED 54 when a switch 58 is closed (e.g., a transistor), causing the LED 54 to emit light. When the switch 58 is open, the current from the current source 56 may stop flowing and the LED 54 may stop emitting light. To provide high-resolution brightness control of the backlight 50, the PWM dimming circuitry 52 supplies a PWM signal to the switch 58. Over time, varying proportions of time that the LED 54 is on relative to time the LED 54 is off causes the average amount of light to vary accordingly. The human eye integrates the amount of light over time and may not see the on-and-off sequence at sufficiently high frequencies, but rather may notice the average brightness.

The PWM signal provided to the switch 58 is shaped in large part by two clocks: a PWM clock 60 that defines a total PWM period and a counter clock 62 that subdivides the PWM clock cycles. The PWM clock 60 may have a frequency in the range of kHz (e.g., 1 kHz, 2 kHz, 4 kHz, 8 kHz, 16 kHz, 24 kHz), while the counter clock 62 may have a frequency in the range of MHz (e.g., 1 MHz, 2 MHz, 4 MHz, 8 MHz, 16 MHz, 24 MHz). The PWM clock 60 has a frequency that is a multiplication factor M times greater than a baseline PWM clock frequency. The baseline PWM clock may have a frequency that, if used as the PWM clock 60 with the counter clock 62, would have a baseline resolution. The baseline resolution may be defined as $\text{Log}_2(F_{COUNT}/F_{PWM})$. For example, when the baseline PWM clock is about 2 kHz and the counter clock 62 is about 16 MHz, the baseline resolution is about 13 bits. The PWM clock 60 may have a substantially higher frequency, however, since it is a value equal to M times the baseline PWM clock frequency. As such, the resolution per PWM clock 60 cycle may be lower, but as will be discussed in greater detail below, the overall baseline resolution will be preserved over M PWM clock 60 cycles.

To generate the PWM signal provided to the switch 58, clock edges of the counter clock 62 (e.g., rising edges, falling edges, or both) may be counted by a digital counter 64 to produce a digital count 66. A digital comparator 68 may compare the digital count 66 to a duty cycle signal 70. The duty cycle signal 70 represents a total number of subdivisions of a PWM clock 60 cycle. The digital comparator 68 issues a reset signal 72 to an SR latch 74 once the digital count 66 exceeds the duty cycle signal 70.

In operation, the SR latch 74 may be set at the start of a PWM clock 60 cycle upon detecting a clock edge (e.g., a rising edge) of the PWM clock 60. The SR latch 74 may produce the PWM signal as a logical "high," causing the switch 58 to close and the LED 54 to emit light. When the digital comparator 68 issues a reset signal 72, the SR latch 74 may be reset and the PWM signal may change to a logical "low." This may cause the switch 58 to open and the LED 54 to stop emitting light. The process may repeat at the start of the next PWM clock 60 cycle.

By way of example, if there are 512 counter clock 62 cycles in one PWM clock 60 cycle, and the duty cycle signal 70 is set to 256 (50% duty cycle), the digital comparator may output a logical "0" until the digital counter 64 counts 257 counter clock 62 edges. At that point, the digital comparator 68 outputs a logical "1" as the reset signal 72, causing the SR latch 74 to reset. As a consequence, in this example, the LED 54 is turned on for the first half of the PWM clock 60 cycle and turned off for the second half of the PWM clock 60 cycle.

Despite having a PWM clock 60 with a frequency that is M times that of a baseline PWM frequency, the PWM dimming circuitry 52 may keep the same resolution. As such, the PWM dimming circuitry 52 may receive a brightness code 76 of the same bit resolution as systems that would use a lower, baseline PWM clock frequency. To preserve the resolution, the PWM dimming circuitry 52 may include division with remainder circuitry 78 that may divide the brightness code 76 by the factor M. The division with remainder circuitry 78 may output the divided brightness code over M PWM clock 60 cycles and a remainder 80 (if there is a remainder) may be added back to the divided brightness code using summation circuitry 82, resulting in the duty cycle signal 70.

The division with remainder circuitry 78 may take any suitable form. For example, the value M may be equal to a value $2^k$. The division with remainder circuitry 78 may perform a shift operation that shifts out k least significant bits (LSBs) of the brightness code 76 as remainders. The remainders may themselves be divided depending on the number M that is used. For example, an initial remainder value obtained when the brightness code 76 is divided by $M=2^k$ may be a k-bit remainder value. The k-bit remainder value may be further divided and further remainders obtained, and so forth. The resulting remainders 80 may be added back into the divided brightness code one or many at a time over M PWM clock 60 cycles. Several examples will be discussed below with reference to FIGS. 8-10, 11-13, 14-16, and 17-19.

The M factor may be fixed or selectable. When the M factor is fixed, the PWM clock 60 may have a single frequency that is M times a baseline frequency that results in a baseline resolution. The baseline resolution is preserved by dividing the brightness code 76 by M, as discussed above. When the M factor is selectable, the PWM clock 60 may be selectable from among multiple possible values of M (e.g., 1, 2, 3, 4, 5, 6, 7, 8). Values of M that take the form $M=2^k$ (e.g., 1, 2, 4, 8, 16, 32, 64, 128, 256) may be particularly effective when working with brightness code 76 values that are defined in binary, since this may simplify division operations. Furthermore, it should be understood that the PWM clock 60 is not necessarily (but may be) the result of the baseline PWM clock multiplied by the value of M. Indeed, the PWM clock 60 may be a clock that is generated in any suitable manner that happens to be equal to a baseline PWM clock that would provide a baseline resolution, multiplied by the value M.

Figure 7:
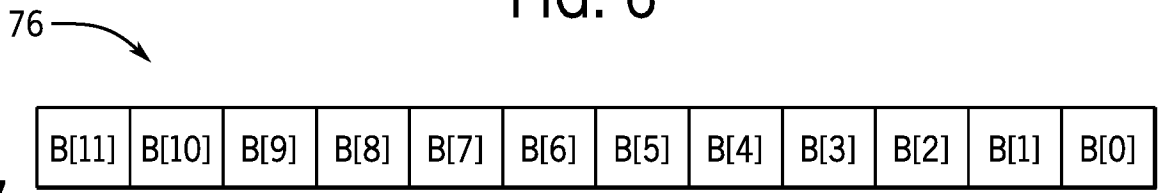
FIG. 7 is an example of a 16-bit input brightness code, in accordance with an embodiment.

FIG. 7 is one schematic example of the brightness code 76. The brightness code 76 may have any suitable resolution that corresponds to the baseline resolution. In the example of FIG. 7, the brightness code 76 has a 12-bit resolution. The bits are labeled B[0] through B[11], with the most-significant bits (MSB) being leftmost and the least significant bits (LSB) being rightmost. However, more or fewer bits of resolution may be used (e.g., 8, 9, 10, 11, 12, 13, 14, 15, 16, 24, 32). The resolution of the brightness code 76 depends on the frequency of the counter clock 62 with respect to a baseline PWM clock frequency. As mentioned above, the baseline resolution may be understood to be approximately equal to logarithm (base 2) of the ratio of the counter clock 62 frequency to the baseline PWM frequency (e.g., $\text{Log}_2$ ($F_{COUNT}/F_{PWM_BASE}$)). As mentioned above, the brightness code 76 is provided to the division with remainder circuitry 78, where it is divided by M (e.g., binary right shift by k when $M=2^k$) to produce M different divided brightness codes. Although the M different divided brightness codes have less resolution individually than the baseline resolution (e.g., when $M=2^k$, the resolution may be k bits lower than the baseline resolution), because the remainder is added back in over M PWM clock 60 cycles, the resolution over M PWM clock 60 cycles remains the same as the baseline resolution.

Example 1: Baseline PWM Resolution of 12 Bits, Brightness=2048/4088

Figure 8:
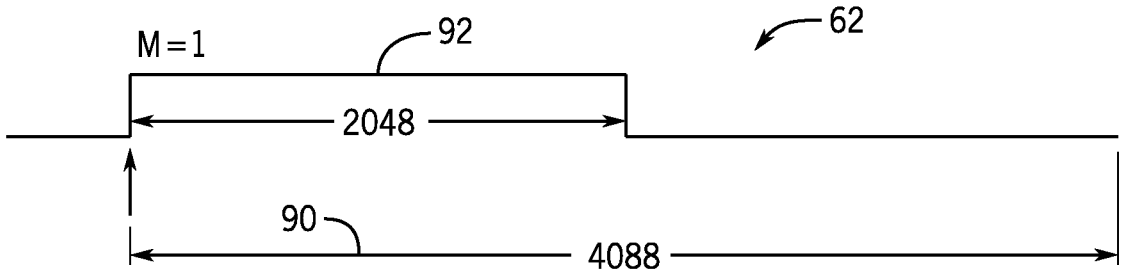
FIG. 8 is a plot of a pulse width modulation (PWM) brightness waveform for a baseline frequency (M=1) in a first example of the operation of the PWM dimming LED driver circuit, in accordance with an embodiment.
Figure 9:
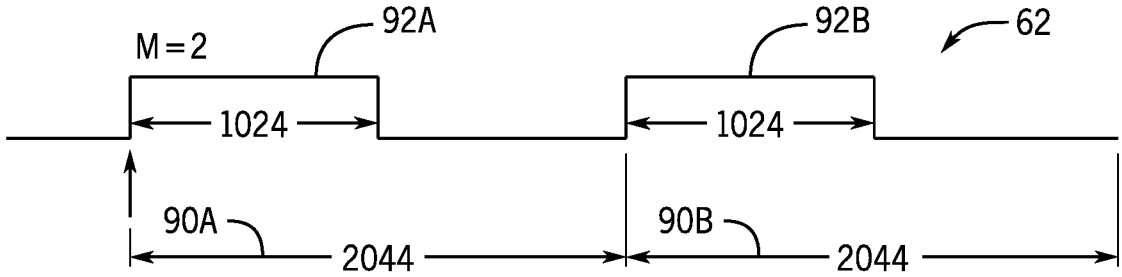
FIG. 9 is a plot of a pulse width modulation (PWM) brightness waveform for a higher frequency (M=2) in the first example of the operation of the PWM dimming LED driver circuit, in accordance with an embodiment.
Figure 10:
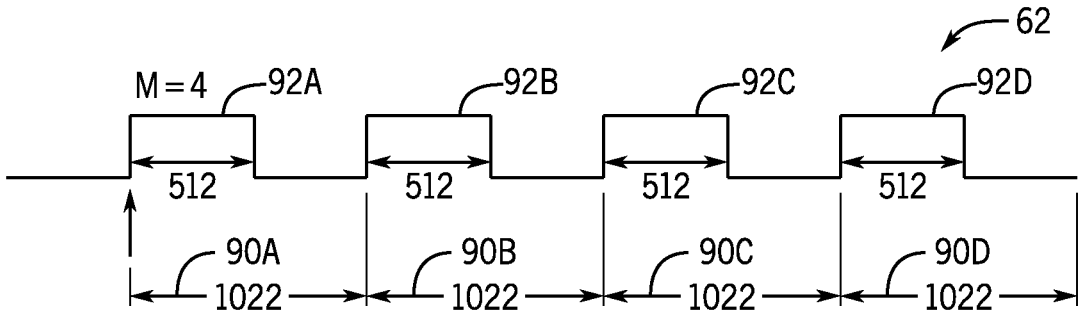
FIG. 10 is a plot of a pulse width modulation (PWM) brightness waveform for a higher frequency (M=4) in the first example of the operation of the PWM dimming LED driver circuit, in accordance with an embodiment.

FIGS. 8-10 describe one example in which a brightness code 76 corresponding to a 12-bit baseline resolution may be used by the PWM dimming circuitry of FIG. 6. In the example of FIGS. 8-10, a brightness value of 50.1% of the backlight is desired, the counter clock is approximately 15.7 MHz, and the baseline PWM clock is approximately 3.84 kHz. This means the baseline resolution is approximately equal to logarithm (base 2) of the ratio of the counter clock 62 frequency to the baseline PWM frequency (e.g., $\text{Log}_2$ ($F_{COUNT}/F_{PWM_BASE}$), a baseline resolution of about 12 bits. Thus, over a single baseline PWM clock cycle at 3.84 kHz, there may be approximately 4088 total clock cycles of the counter clock at 15.7 MHz. For FIGS. 8-10, the brightness code defines a count of 2048 out of 4088.

FIG. 8 describes a condition in which M=1, meaning that the PWM clock 60 has the baseline frequency and a maximum pulse width 90 per PWM clock 60 cycle is 4088 cycles of the counter clock 62. Achieving a desired brightness level of about 50.1% involves a PWM pulse width 92 equal to about 2048 out of the total 4088 counter clock cycles.

When M=2, as shown in FIG. 9, the PWM clock 60 has a frequency that is double that of the PWM baseline frequency. Since twice as many PWM clock 60 cycles in FIG. 9 occur in the same amount of time as one PWM clock 60 cycle of FIG. 8, there are two maximum pulse widths 90A and 90B, each occurring over 2044 clock cycles of the counter clock. By dividing the brightness code of 2048 by M=2, two pulses 92A and 92B having pulse widths of 1024 counter clock cycles may be generated. As can be seen, the overall duty cycle shown in FIG. 9 is equivalent to that shown in FIG. 8.

The duty cycle may also remain equivalent for condition where M is greater. For example, as shown in FIG. 10, when M=4, the PWM clock 60 has a frequency that is four times that of the PWM baseline frequency. Since four times as many PWM clock 60 cycles in FIG. 10 occur in the same amount of time as one PWM clock 60 cycle of FIG. 8, there are four maximum pulse widths 90A, 90B, 90C, and 90D, each occurring over 1022 clock cycles of the counter clock. By dividing the brightness code of 2048 by M=4, four pulses 92A, 92B, 92C, and 92D of 512 counter clock cycles each may be generated. As can be seen, the overall duty cycle shown in FIG. 10 is equivalent to that shown in FIGS. 8 and 9. Thus, even though the PWM clock 60 is substantially higher in the example of FIG. 10, the resolution of the brightness code remains the same as that of FIG. 8.

Example 2: Baseline PWM Resolution of 12 Bits, Brightness=2049/4088

Figure 11:
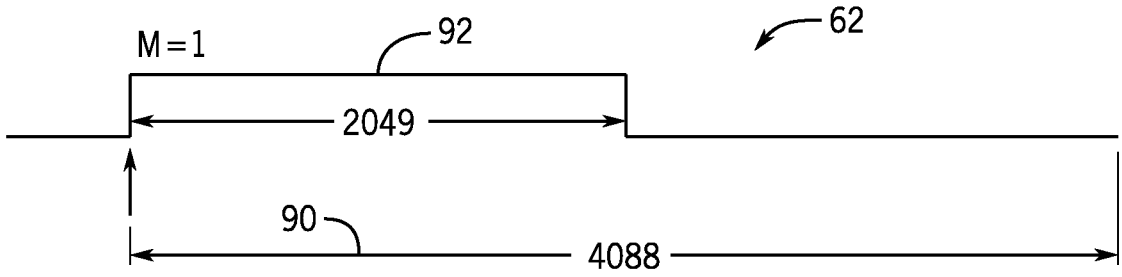
FIG. 11 is a plot of a pulse width modulation (PWM) brightness waveform for a baseline frequency (M=1) in a second example of the operation of the PWM dimming LED driver circuit, in accordance with an embodiment.
Figure 12:
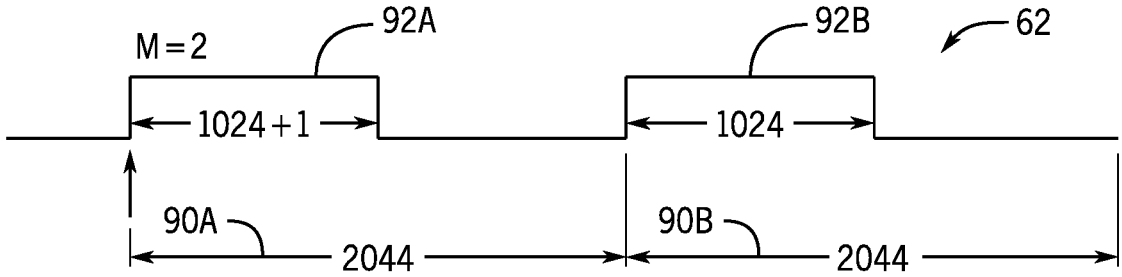
FIG. 12 is a plot of a pulse width modulation (PWM) brightness waveform for a higher frequency (M=2) in the second example of the operation of the PWM dimming LED driver circuit, in accordance with an embodiment.
Figure 13:
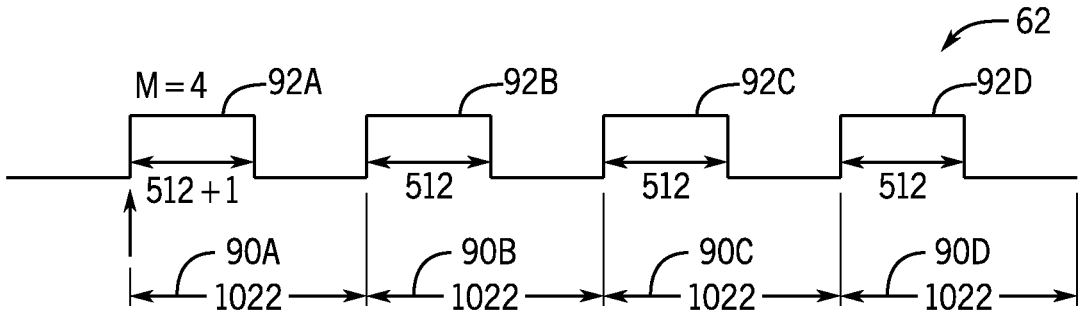
FIG. 13 is a plot of a pulse width modulation (PWM) brightness waveform for a higher frequency (M=4) in the second example of the operation of the PWM dimming LED driver circuit, in accordance with an embodiment.

The PWM dimming circuitry 52 of FIG. 6 may also be used to preserve resolution when the brightness code does not evenly divide by two. FIGS. 11-13 describe another example in which a brightness code 76 corresponding to a 12-bit baseline resolution may be used by the PWM dimming circuitry of FIG. 6. In the example of FIGS. 11-13, the counter clock is approximately 15.7 MHz, and the baseline PWM clock is approximately 3.84 kHz. This means the baseline resolution is about 12 bits. Thus, over a single baseline PWM clock cycle at 3.84 kHz, there may be approximately 4088 total clock cycles of the counter clock at 15.7 MHz. For FIGS. 11-13, the brightness code defines a count of 2049 out of 4088.

In FIG. 11, the value M=1, meaning that the PWM clock 60 has the baseline frequency and a maximum pulse width 90 per PWM clock 60 cycle is 4088 cycles of the counter clock. A PWM pulse width 92 equal to about 2049 out of the total 4088 counter clock cycles has been selected.

When M=2, as shown in FIG. 12, the PWM clock 60 has a frequency that is double that of the PWM baseline frequency. Since twice as many PWM clock 60 cycles in FIG. 12 occur in the same amount of time as one PWM clock 60 cycle of FIG. 11, there are two maximum pulse widths 90A and 90B, each occurring over 2044 clock cycles of the counter clock. By dividing the brightness code of 2049 by M=2, two pulses 92A and 92B having pulse widths of 1024 counter clock cycles may be generated, leaving a remainder of 1. The remainder of 1 may be added to one of the pulses 92A and 92B. Here, the pulse 92A has received the remainder for a total pulse width of 1024+1=1025. Totaling both pulses 92A and 92B of FIG. 12 yields a pulse width of 1025+1024=2049 counter clock cycles, equivalent to that of FIG. 11.

When M=4, as shown in FIG. 13, the PWM clock 60 has a frequency that is four times that of the PWM baseline frequency. Since four times as many PWM clock 60 cycles in FIG. 13 occur in the same amount of time as one PWM clock 60 cycle of FIG. 11, there are four maximum pulse widths 90A, 90B, 90C, and 90D, each occurring over 1022 clock cycles of the counter clock. By dividing the brightness code of 2049 by M=4, four pulses 92A, 92B, 92C, and 92D having pulse widths of 512 counter clock cycles each may be generated, leaving a remainder of 1. The remainder of 1 may be added to one of the pulses 92A, 92B, 92C, or 92D. In FIG. 13, the pulse 92A has received the remainder for a total width of 512+1=513. Totaling all four pulses 92A, 92B, 92C, and 92D of FIG. 13 yields 513+512+512+512=2049 counter clock cycles, equivalent to that of FIGS. 11 and 12. Thus, even though the PWM clock 60 is substantially higher in the example of FIG. 13, the resolution of the brightness code remains the same as that of FIG. 11.

Example 3: Baseline PWM Resolution of 12 Bits, Brightness=2050/4088

Figure 14:
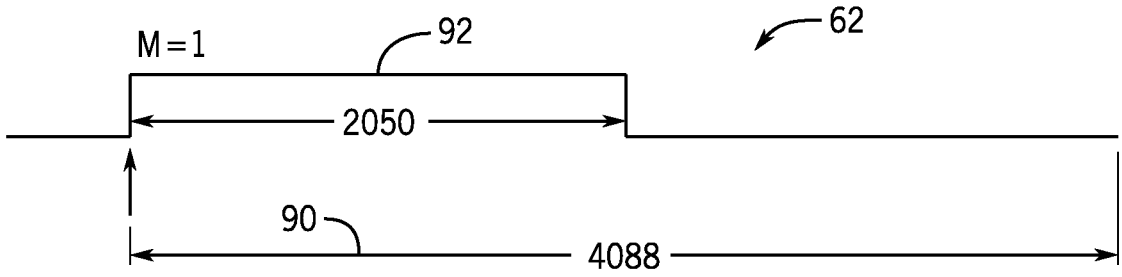
FIG. 14 is a plot of a pulse width modulation (PWM) brightness waveform for a baseline frequency (M=1) in a third example of the operation of the PWM dimming LED driver circuit, in accordance with an embodiment.
Figure 15:
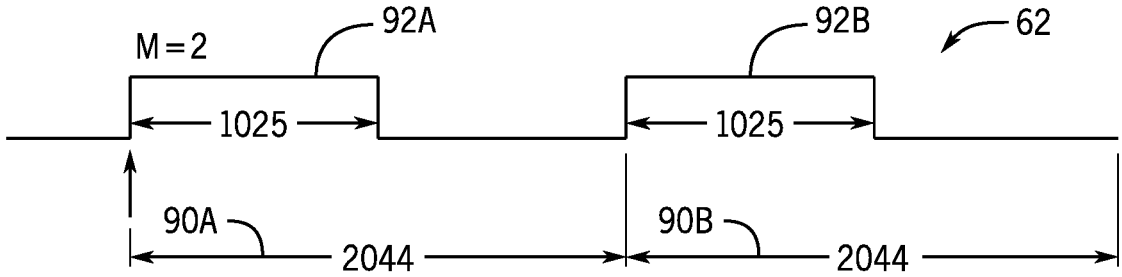
FIG. 15 is a plot of a pulse width modulation (PWM) brightness waveform for a higher frequency (M=2) in the third example of the operation of the PWM dimming LED driver circuit, in accordance with an embodiment.
Figure 16:
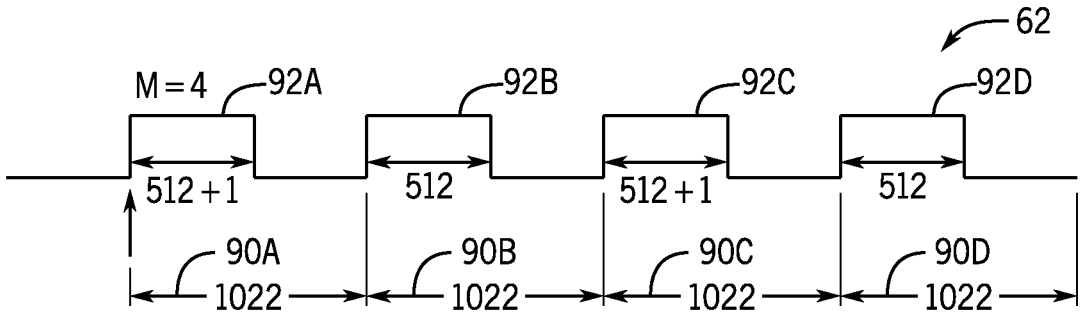
FIG. 16 is a plot of a pulse width modulation (PWM) brightness waveform for a higher frequency (M=4) in the third example of the operation of the PWM dimming LED driver circuit, in accordance with an embodiment.

FIGS. 14-16 describe another example in which a brightness code 76 corresponding to a 12-bit baseline resolution may be used by the PWM dimming circuitry of FIG. 6. In the example of FIGS. 14-16, the counter clock is approximately 15.7 MHz, and the baseline PWM clock is approximately 3.84 kHz. This means the baseline resolution is about 12 bits. Thus, over a single baseline PWM clock cycle at 3.84 kHz, there may be approximately 4088 total clock cycles of the counter clock at 15.7 MHz. For FIGS. 14-16, the brightness code defines a count of 2050 out of 4088.

In FIG. 14, the value M=1, meaning that the PWM clock 60 has the baseline frequency and a maximum pulse width 90 per PWM clock 60 cycle is 4088 clock cycles of the counter clock. A PWM pulse width 92 equal to about 2050 out of the total 4088 counter clock cycles has been selected.

When M=2, as shown in FIG. 15, the PWM clock 60 has a frequency that is double that of the PWM baseline frequency. Since twice as many PWM clock 60 cycles in FIG. 15 occur in the same amount of time as one PWM clock 60 cycle of FIG. 14, there are two maximum pulse widths 90A and 90B, each occurring over 2044 clock cycles of the counter clock. By dividing the brightness code of 2050 by M=2, two pulses 92A and 92B having pulse widths of 1025 counter clock cycles may be generated. Totaling both pulses 92A and 92B of FIG. 12 yields a pulse width of 1025+1025=2050 counter clock cycles, equivalent to that of FIG. 14.

When M=4, as shown in FIG. 16, the PWM clock 60 has a frequency that is four times that of the PWM baseline frequency. Since four times as many PWM clock 60 cycles in FIG. 16 occur in the same amount of time as one PWM clock 60 cycle of FIG. 14, there are four maximum pulse widths 90A, 90B, 90C, and 90D, each occurring over 1022 pulses of the counter clock. By dividing the brightness code of 2050 by M=4, four pulses 92A, 92B, 92C, and 92D having pulse widths of 512 counter clock cycles each may be generated, with two remainders of 1. The remainders of 1 may be added to two different of the pulses 92A, 92B, 92C, or 92D. In FIG. 16, the pulses 92A and 92C have received the remainder for total pulse widths of 512+1=513. Totaling all four pulses 92A, 92B, 92C, and 92D of FIG. 16 yields a pulse width of 513+512+513+512=2050 counter clock cycles, equivalent to that of FIGS. 14 and 15. Thus, even though the PWM clock 60 is substantially higher in the example of FIG. 16, the resolution of the brightness code remains the same as that of FIG. 14.

Example 4: Baseline PWM Resolution of 12 Bits, Brightness=2051/4088

Figure 17:
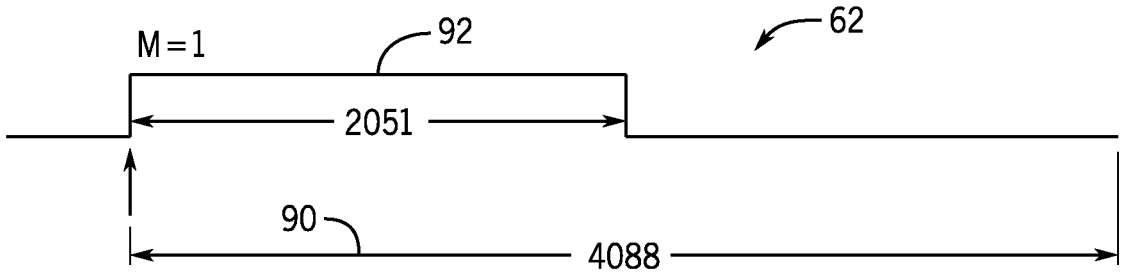
FIG. 17 is a plot of a pulse width modulation (PWM) brightness waveform for a baseline frequency (M=1) in a fourth example of the operation of the PWM dimming LED driver circuit, in accordance with an embodiment.
Figure 18:
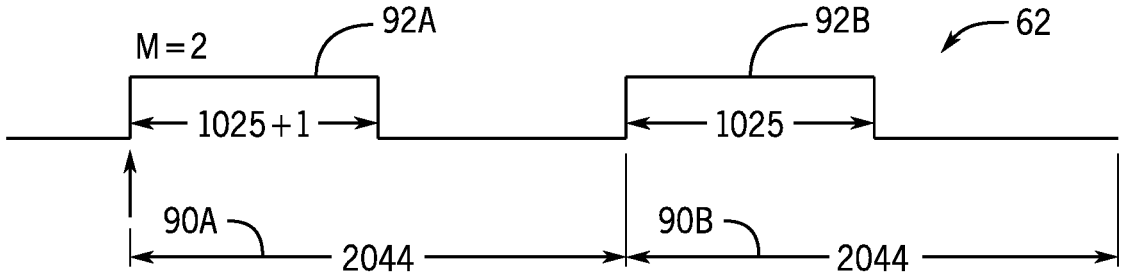
FIG. 18 is a plot of a pulse width modulation (PWM) brightness waveform for a higher frequency (M=2) in the fourth example of the operation of the PWM dimming LED driver circuit, in accordance with an embodiment.
Figure 19:
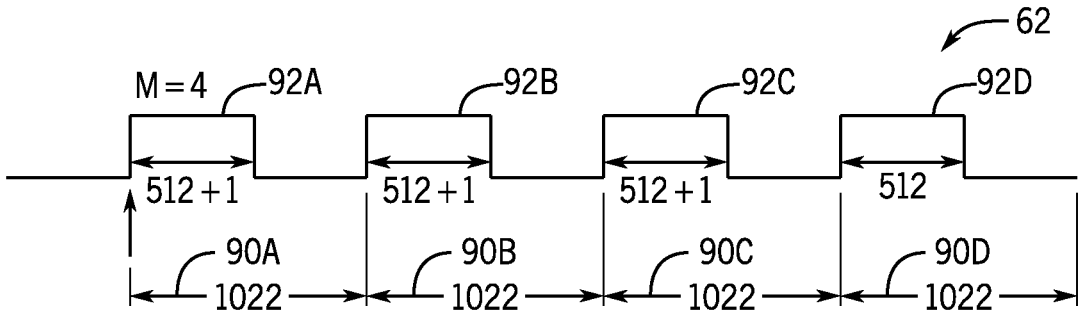
FIG. 19 is a plot of a pulse width modulation (PWM) brightness waveform for a higher frequency (M=4) in the fourth example of the operation of the PWM dimming LED driver circuit, in accordance with an embodiment.

FIGS. 17-19 describe another example in which a brightness code 76 corresponding to a 12-bit baseline resolution may be used by the PWM dimming circuitry of FIG. 6. In the example of FIGS. 17-19, the counter clock is approximately 15.7 MHz, and the baseline PWM clock is approximately 3.84 kHz. This means the baseline resolution is about 12 bits. Thus, over a single baseline PWM clock cycle at 3.84 kHz, there may be approximately 4088 total clock cycles of the counter clock at 15.7 MHz. For FIGS. 17-19, the brightness code defines a count of 2051 out of 4088.

In FIG. 17, the value M=1, meaning that the PWM clock 60 has the baseline frequency and a maximum pulse width 90 per PWM clock 60 cycle is 4088 clock cycles of the counter clock. A PWM pulse width 92 equal to about 2050 out of the total 4088 counter clock cycles has been selected.

When M=2, as shown in FIG. 18, the PWM clock 60 may have a frequency that is double that of the PWM baseline frequency. Since twice as many PWM clock 60 cycles in FIG. 18 occur in the same amount of time as one PWM clock 60 cycle of FIG. 17, there are two maximum pulse widths 90A and 90B, each occurring over 2044 clock cycles of the counter clock. By dividing the brightness code of 2051 by M=2, two pulses 92A and 92B having a pulse width of 1025 counter clock cycles may be generated, with a remainder of 1. The remainder of 1 may be added to one of the pulses 92A and 92B. Here, the pulse 92A has received the remainder for a total pulse width of 1025+1=1026. Totaling both pulses 92A and 92B of FIG. 12 yields a pulse width of 1026+1025=2051 counter clock cycles, equivalent to that of FIG. 17.

When M=4, as shown in FIG. 19, the PWM clock 60 may have a frequency that is four times that of the PWM baseline frequency. Since four times as many PWM clock 60 cycles in FIG. 19 occur in the same amount of time as one PWM clock 60 cycle of FIG. 17, there are four maximum pulse widths 90A, 90B, 90C, and 90D, each occurring over 1022 pulses of the counter clock. By dividing the brightness code of 2051 by M=4, four pulses 92A, 92B, 92C, and 92D of 512 pulses each may be generated, with three remainders of 1. The remainders of 1 may be added to three different the pulses 92A, 92B, 92C, or 92D. In FIG. 16, the pulses 92A, 92B, and 92C have received the remainder for total widths of 512+1=513. Totaling all four pulses 92A, 92B, 92C, and 92D of FIG. 19 yields 513+513+513+512=2051 pulses, equivalent to that of FIGS. 17 and 18. Thus, even though the PWM clock 60 is substantially higher in the example of FIG. 19, the resolution of the brightness code remains the same as that of FIG. 17.

While the remainder in the example of FIG. 19 is applied one per pulse 92A, 92B, and 92C, the remainder may instead be distributed to a single pulse or between two pulses. For example, the remainder of three obtained during the division by M may be added just to the pulse 92A. In such a case, totaling all four pulses 92A, 92B, 92C, and 92D may yield 515+512+512+512=2051 pulses, equivalent to that of FIGS. 17, 18, and 19. In another example, the remainder of three obtained during the division by M may be added to the pulses 92A and 92B. In such a case, totaling all four pulses 92A, 92B, 92C, and 92D of FIG. 13 may yield 514+513+512+512=2051 pulses, also equivalent to that of FIGS. 17, 18, and 19.

Moreover, although the examples of FIGS. 8-19 involve M factors of 1, 2, and 4, other any other suitable values may be used. In one example, the M factor may be any suitable value of form $2^k$, where k is a positive integer value. This format allows for division in the form of binary shifting. In other examples, M may take a different form (e.g., 3, 5, 6, 7, or the like), but the division operation may be slightly more complex.

Additional Dithering

Figure 20:
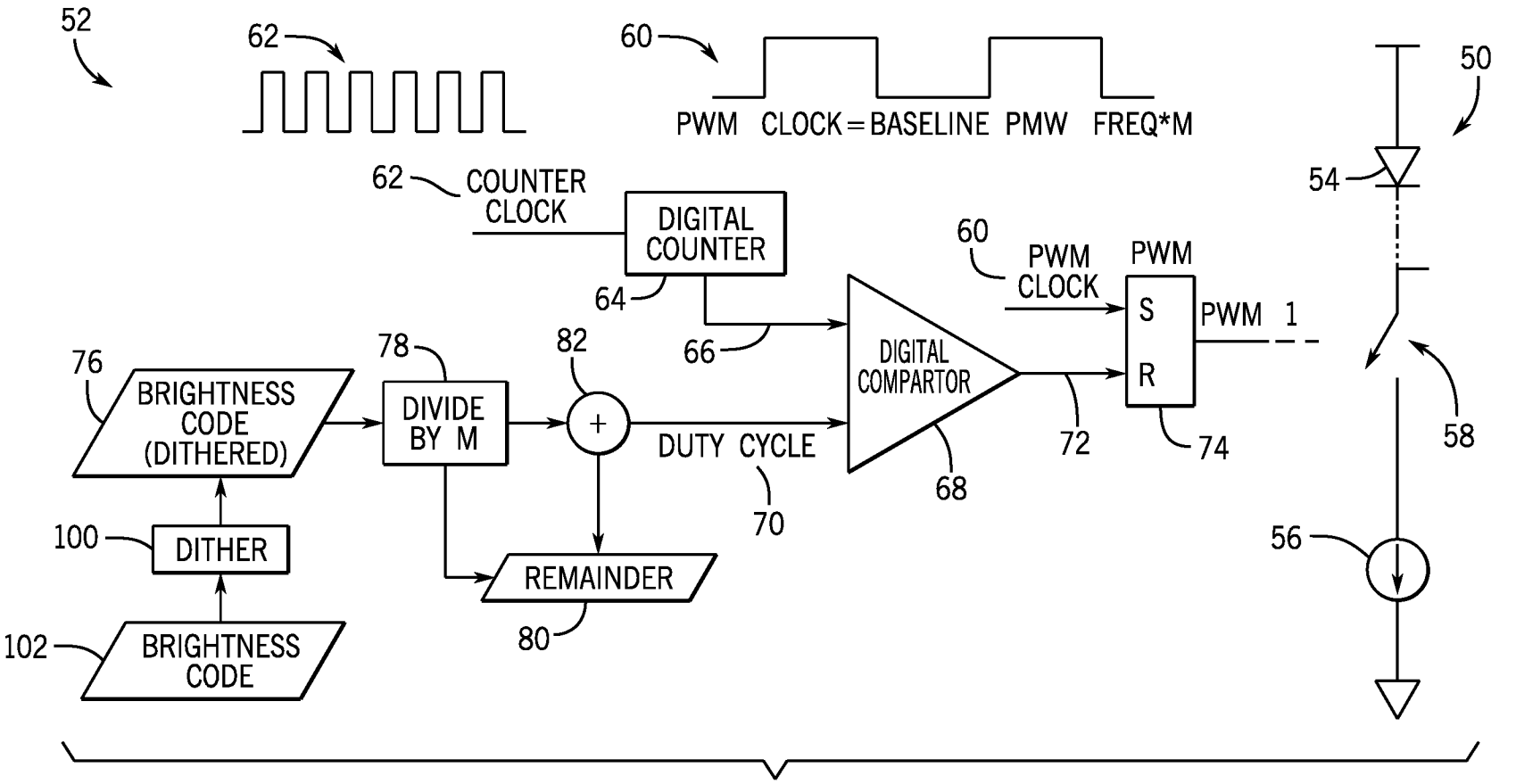
FIG. 20 is a schematic diagram of a pulse width modulation (PWM) dimming LED driver circuit receiving dithered brightness codes, in accordance with an embodiment.

Dithering may also be used to achieve additional resolution beyond the baseline PWM resolution. For example, as shown in FIG. 20, a dithering block 100 may receive a higher-resolution brightness code 102 having a resolution that is greater than the baseline resolution of the PWM dimming circuitry 52. The dithering block 100 may dither the higher-resolution brightness code 102 to obtain the brightness code 76 at the baseline resolution. Subsequently, the remaining circuitry of the PWM dimming circuitry 52 may operate in same manner as described with respect to FIG. 6. Thus, description of the operation of these elements may be understood from reading the description corresponding to FIG. 6.

The dithering block 100 may be part of the electronic display 12 or another part of the electronic device 10. For example, the dithering block 100 may represent specialized circuitry in the electronic display 12 or the processor core complex 18 that carries out a dithering technique. Additionally or alternatively, the dithering block 100 may represent a program running on a processor (e.g., a local processor of the electronic display 12 or an application processor of the processor core complex 18) as defined by instructions stored on an article of manufacture such as a memory or storage device.

Figure 21:
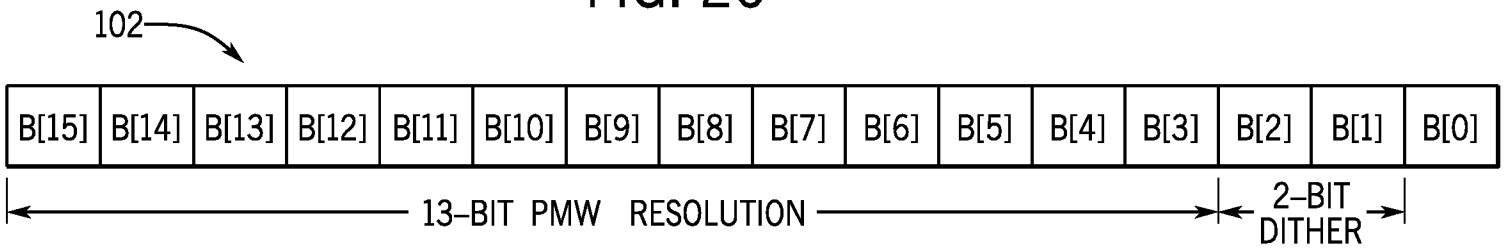
FIG. 21 is an example of a 16-bit input brightness code that includes dithering bits, in accordance with an embodiment.

The brightness code 102 may contain additional bits of resolution that are used by the dithering block 100 to obtain additional resolution from the PWM dimming circuitry 52 beyond the baseline resolution. One example of the brightness code 102 is shown in FIG. 21. In the example of FIG.

21, there are 15 bits of resolution: 13 bits corresponding to the PWM baseline resolution and 2 dither bits. In this particular example, the 13 most significant bits [B15]—[B3] correspond to the PWM baseline resolution bits and the next most significant bits [B2]—[B1] correspond to the dither bits. The least significant bit [B0] may be unused in this example. The dither block 100 may use the dither bits in a table that defines whether to add to or subtract from the 13-bit PWM baseline resolution to obtain the brightness code 76. Although the example here employs a 2-bit dithering scheme, different numbers of bits may be used in a dithering scheme (e.g., 1-bit, 3-bit, 4-bit, 5-bit).

The dither block 100 may perform dithering in any suitable manner. In one example, the dither block 100 may spread the dither bits over different brightness codes 76 according to a table. Table 1 below represents one such arrangement. Here, the dither block 100 may spread two dither bits of the higher-resolution brightness code 102 over four different brightness codes 76. The dither block 100 may provide four brightness codes 76, each one provided for a time period corresponding to a baseline PWM clock cycle. Table 1 illustrates one way in which the dithering bits may be distributed (e.g., added) to four sequential brightness codes 76 for four baseline PWM periods.

TABLE 1

| LED PWM Dithering Control Bits | | | | |
|---|---|---|---|---|
| Brightness Code | 00b | 01b | 10b | 11b |
| 1st | 0 | 1 | 1 | 1 |
| 2nd | 0 | 0 | 0 | 1 |
| 3rd | 0 | 0 | 1 | 1 |
| 4th | 0 | 0 | 0 | 0 |

The resulting brightness codes 76 that are output by the dithering block 100 may be subsequently handled by the PWM dimming circuitry 52 in the manner discussed above with reference to FIG. 6. The inclusion of the dithering block 100 to enable PWM dithering may allow yet more PWM resolution.

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

It is well understood that the use of personally identifiable information should follow privacy policies and practices that are generally recognized as meeting or exceeding industry or governmental requirements for maintaining the privacy of users. In particular, personally identifiable information data should be managed and handled so as to minimize risks of unintentional or unauthorized access or use, and the nature of authorized use should be clearly indicated to users.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. An electronic display backlight system comprising:

a backlight element configured to be driven according to a pulse width modulation (PWM) signal over a PWM clock cycle equal to a multiple M of a baseline PWM clock frequency associated with a baseline PWM resolution, wherein the multiple M is a positive integer; and backlight dimming circuitry configured to receive a brightness code of the baseline PWM resolution and generate the PWM signal at least in part by dividing the brightness code by M.

2. The electronic display backlight system of claim 1, wherein the backlight dimming circuitry is configured to generate the PWM signal at least in part by obtaining a remainder from the division and adding the remainder to the divided brightness code.

3. The electronic display backlight system of claim 1, wherein the backlight dimming circuitry is configured to divide the brightness code using a binary shift operation.

4. The electronic display backlight system of claim 1, wherein the multiple M is equal to a value $2^k$, where k is a positive integer.

5. The electronic display backlight system of claim 4, wherein the backlight dimming circuitry is configured to divide the brightness code by shifting the brightness code by k bits.

6. The electronic display backlight system of claim 1, wherein the backlight dimming circuitry is configured to use the divided brightness code to generate the PWM signal for M PWM clock cycles.

7. The electronic display backlight system of claim 1, wherein the baseline PWM resolution comprises at least 12 bits.

8. The electronic display backlight system of claim 1, comprising dither circuitry configured to:

receive a higher-resolution brightness code that exceeds the baseline PWM resolution; and apply dithering to produce the brightness code of the baseline PWM resolution.

9. A method comprising:

receiving a brightness code having a bit depth corresponding to a baseline resolution for a pulse width modulation system using a first counter clock frequency and a first pulse width modulation (PWM) clock frequency;

dividing the brightness code by a value M using division circuitry to obtain a divided brightness code, wherein the value M is a positive integer;

adding a remainder of the division to the divided brightness code;

comparing the divided brightness code to a count of a counter clock having the first counter clock frequency over a first PWM clock having a second PWM clock frequency equal to the value M times the first PWM clock frequency; and providing a pulse width modulation PWM signal to cause a light emitting element to emit light during the first PWM clock while the count is lower than the divided brightness code.

10. The method of claim 9, wherein the value M equals at least 4.

11. The method of claim 10, wherein the remainder is greater than one and the remainder is added to the divided brightness code over more than one clock cycle of the first PWM clock.

12. The method of claim 10, wherein the remainder is greater than one and the remainder is added to the divided brightness code for one clock cycle of the first PWM clock.

13. The method of claim 9, wherein the value M is equal to a value $2^k$, where k is a positive integer.

14. The method of claim 13, wherein the brightness code is divided by shifting the brightness code by k.

15. The method of claim 9, comprising:

receiving a higher-resolution brightness code having a bit depth that exceeds that of the brightness code of the baseline resolution; and dithering the higher-resolution brightness code to produce the brightness code of the baseline resolution.

16. The method of claim 15, wherein the dithering is performed using circuitry of an electronic device connected to an electronic display and the dividing is performed using circuitry of the electronic display.

17. Pulse width modulation (PWM) backlight control circuitry comprising:

division circuitry configured to divide a PWM brightness code by a value M to obtain a divided brightness code, wherein the value M is a positive integer;

adder circuitry configured to add a remainder of the division to the divided brightness code to obtain a duty cycle signal;

a counter configured to count certain edges of a counter clock having a first frequency over a period corresponding to one clock cycle of a PWM clock, wherein the PWM clock has a second frequency that is equal to M times a third frequency corresponding to a baseline PWM clock that, when used with the counter clock having the first frequency, would result in a baseline PWM resolution;

a digital comparator configured to compare the count of the certain edges of the counter clock to the duty cycle signal and output a reset signal when the count of the certain edges of the counter clock exceeds a value of the duty cycle signal; and a latch configured to output a PWM signal that causes a light emitting element to emit light when the latch is set by a certain edge of the PWM clock and to stop emitting light when the latch is reset by the reset signal;

wherein the adder circuitry is configured to add the remainder to the divided brightness code to cause the duty cycle signal to have an average resolution over M PWM clock cycles that is equivalent to the baseline PWM resolution.

18. The circuitry of claim 17, wherein the adder circuitry is configured to add the remainder to the divided brightness code over M cycles of the PWM clock.

19. The circuitry of claim 17, wherein the adder circuitry is configured to add the remainder to the divided brightness code over a single cycle of the PWM clock.

20. The circuitry of claim 17, comprising dither circuitry configured to:

receive a higher-resolution brightness code that exceeds the baseline PWM resolution; and apply dithering to produce the PWM brightness code, wherein the PWM brightness code has the baseline PWM resolution.

21. The circuitry of claim 17, wherein the PWM clock has a frequency inaudible to humans.

* * * * *